US008668363B2

(12) United States Patent
Vogt et al.

(10) Patent No.: US 8,668,363 B2
(45) Date of Patent: Mar. 11, 2014

(54) ARRANGEMENT OF LAMP SOCKET AND LAMP BASE

(75) Inventors: Karl-Wilhelm Vogt, Ense (DE); Markus Pieper, Arnsberg (DE)

(73) Assignee: BJB GmbH & Co. KG, Arnsberg (DE)

( * ) Notice: Subject to any disclaimer, the term of this patent is extended or adjusted under 35 U.S.C. 154(b) by 0 days.

(21) Appl. No.: 13/360,682

(22) Filed: Jan. 28, 2012

(65) Prior Publication Data

US 2013/0034989 A1 Feb. 7, 2013

Related U.S. Application Data

(63) Continuation of application No. PCT/DE2010/000655, filed on Jun. 9, 2010.

(30) Foreign Application Priority Data

Sep. 4, 2009 (DE) ..... 10 2009 040 115

(51) Int. Cl.
*F21V 29/00* (2006.01)

(52) U.S. Cl.
USPC ..... 362/294; 362/373; 362/655; 362/657; 257/99

(58) Field of Classification Search
USPC ..... 257/99; 362/218, 294, 373, 547, 362/655–659; 439/487
See application file for complete search history.

(56) References Cited

U.S. PATENT DOCUMENTS

| | | | | |
|---|---|---|---|---|
| 4,398,240 | A | 8/1983 | Savage, Jr. | |
| 5,857,767 | A | 1/1999 | Hochstein | |
| 5,984,488 | A | 11/1999 | Tung | |
| 7,866,850 | B2 * | 1/2011 | Alexander et al. | 362/294 |
| 2007/0236935 | A1 | 10/2007 | Wang | |
| 2008/0274641 | A1 | 11/2008 | Weber et al. | |
| 2011/0063849 | A1 * | 3/2011 | Alexander et al. | 362/294 |

FOREIGN PATENT DOCUMENTS

| | | | |
|---|---|---|---|
| DE | 42 43 175 | A1 | 4/1994 |
| DE | 103 16 512 | A1 | 10/2004 |
| DE | 20 2006 015881 | U1 | 1/2007 |
| DE | 20 2007 012249 | U1 | 11/2007 |
| DE | 10 2007 042 978 | A1 | 3/2009 |
| DE | 10 2007 041126 | A1 | 3/2009 |
| WO | WO 02/12788 | A1 | 2/2002 |

* cited by examiner

*Primary Examiner* — Stephen F Husar

(74) *Attorney, Agent, or Firm* — Von Rohrscheldt Patents

(57) ABSTRACT

A lamp socket for supporting a light source provided with an LED, the lamp socket including a cooling element; a socket housing which includes socket contacts for electrically connecting the light source; and a lamp base which supports an LED connected to a heat conducting element and is insertable in the socket housing and includes base contacts which are connectable with the socket contacts through a contact force for providing power to the LED, wherein the cooling element on the socket side is connected with the heat conducting element on the base side with a contact pressure that promotes heat transfer, wherein the contact pressure is provided through a pressing force in order for the cooling element to absorb heat generated by the LED, wherein the electric contact between the socket contacts and the base contacts is provided so that it does not provide forces opposite to the pressing force.

10 Claims, 14 Drawing Sheets

ARRANGEMENT OF LAMP SOCKET AND LAMP BASE

RELATED APPLICATIONS

This application is a continuation of International application PCT/DE2010/000655 filed on Jun. 9, 2010 claiming priority from German application DE 20 2009 010 577.6 filed on Aug. 5, 2009 and German application DE 10 2009 040 115.6 filed on Sep. 4, 2009. All the above applications are incorporated in their entirety by this reference.

FIELD OF THE INVENTION

The invention relates to a lamp socket for supporting a light source provided with an LED, the lamp socket including a cooling element and a socket housing, which includes socket contacts for electrically connecting the LED, and a lamp base which supports an LED connected to a heat conducting element and which is insertable into the socket housing and includes base contacts, which are electrically contactable through the socket contacts through a contact force in order to supply the LED with power, wherein the cooling element on the socket side is connected with the thermally conductive element on the LED side—possibly through a device that promotes heat transfer, such as thermally conductive foil or thermally conductive paste—with a contact pressure that promotes heat transfer, wherein the contact pressure is provided through a contact force produced through a suitable device in order to absorb heat generated by the LED during operations.

BACKGROUND OF THE INVENTION

Lamp sockets of this type are known in the art. They are typically configured as compact fluorescent lamp sockets and lamp bases, wherein the lamp base is inserted into the socket and fixated through a rotation like a bayonet. Differently from fluorescent tubes, these configurations are designated as one side socket systems. Through the rotation, furthermore the socket and base contacts are connected with one another and the lamp is electrically contacted. This locking principle is also known as twist lock system. Lamp sockets are also known in the art in particular for light sources provided LEDs, where the base is inserted parallel to a surface of a cooling element, wherein this process also includes electrical contacting.

In the art it was the object of a lamp socket and a lamp base to mechanically support and electrically contact the lamp.

The service life of illuminants based on LEDs, however, depends from an optimum dissipation of the heat generated during operation of the LED. LEDs are particularly temperature sensitive. Therefore, lamp bases of this type include a heat conducting element which contacts a cooling element arranged at the socket. It is evident that a particular contact pressure between heat conducting element and cooling element positively influences heat transfer. Thus, sockets and bases for a light source including at least one LED are characterized in that besides the mechanical support and the electrical support, optimum heat dissipation has to be provided. Thus, sockets and bases for LED illuminants with respect to their configurative requirements greatly differ from their equivalents for compact fluorescent lamps.

In arrangements of lamp socket and lamp base according to the prior art, it has become apparent that the contact pressure between a base side heat conducting element and a socket side cooling element is not the sole measure for the quality of the heat transfer. In spite of a contact pressure accordingly provided, many sockets cause premature aging of the LEDs. Tests have shown that an even distribution of the contact pressure over the contact surfaces of heat conducting element and cooling element determines the quality of the heat transfer.

BRIEF SUMMARY OF THE INVENTION

Thus it is the object of the invention to provide a lamp socket and a lamp base which provide evenly distributed contact pressure over a contact surface between heat conducting element and cooling element.

The object is achieved by a lamp socket and a lamp base with a cooling element, a socket housing which includes socket contacts for electrically connecting a light source, and a lamp base which supports an LED connected to a heat conducting element and is insertable in the socket housing and includes base contacts which are connectable with the socket contacts through a contact force for providing power to the LED. The cooling element on a socket side is connected with the heat conducting element on a base side (optionally through a device that promotes heat transfer, such as heat conducting foil or heat conducting paste) through a contact pressure that promotes heat transfer. The contact pressure is provided through a pressing force produced through a suitable device in order for the cooling element to absorb heat generated by the LED during operation, and the electrical connection between the socket contacts and the base contacts is provided through a contact configuration and/or a contact support that does not provide forces opposite to the pressing force. In particular the object is achieved with the electrical contacting between the socket contacts and the base contacts is provided by configuring and/or supporting the contacts without an opposite force to the contact force.

The invention uses the finding that already small force components that are oriented against the contact force providing the contact pressure significantly change the pressure distribution. Based on this, the invention prevents electrical contacting in which the contact forces are oriented against the pressing force through appropriate configuration of socket and base contacts or their support in the socket housing or at the lamp base.

An embodiment is advantageous in particular which is characterized in that the contact force between the socket contacts and the base contacts includes a force component which is oriented transversal to the effective direction of the pressing force.

Alternatively, it is conceivable that the contact force between the socket contacts and the base contacts has a force component that is oriented in the effective direction of the pressing force and does not influence an even distribution of the contact pressure.

Both recited embodiments provide that the effective direction of the contact forces does not negatively influence the pressing force and an even distribution of the pressing force.

It is even conceivable that the contacting between the socket contacts and the base contacts is provided in a manner that increases the pressing force.

A particular embodiment provides that the base contacts are configured as contacts which protrude from the base towards the cooling element, in particular as contact pins, wherein the contact force between the socket contacts and the base contacts is oriented transversal to the effective direction of the pressing force.

As a supplement thereto, it can be provided that the base contacts are configured as contact clamps which support the base contacts, in particular support the contact pins between two contact arms. It is particularly advantageous that the contact clamps which receive the base contacts between one another provide secure electrical contacting.

Alternatively it is conceivable that the base contacts are configured as contacts laterally protruding from the base circumference, in particular contacts oriented transversal to an effective direction of the pressing force like, for example, flat blade contacts and the contact forces between the socket contacts and the base contacts have an identical effective direction as the pressing force. With an even distribution of the flat blade contacts over the base circumference, this embodiment does not negatively influence an even contact pressure distribution on the contact surfaces of the heat conducting element and the cooling element.

However, it is also conceivable to provide a contact arrangement in which contact forces are provided which are oriented against the effective direction of the pressing force without the contact forces that are negative with respect to the effective direction of the pressing force influencing the contact pressure between the heat conducting element and the cooling element. An embodiment of this type is characterized in that the socket contacts are configured as a contact clamp and receive the socket contacts, in particular the flat blade contacts between one another and the contact forces of the contact arms receiving the socket contacts between one another are oriented opposite to one another and are oriented parallel to the effective direction of the pressing force, wherein the socket contacts are supported floating in the socket housing parallel to the effective direction of the pressing force and/or the socket contacts are supported parallel to the effective direction of the pressing force and are supported floating in the lamp socket.

Eventually an embodiment is conceivable which is characterized in that contact fields are configured at the socket or at the base where the base contacts or the socket contacts contact, wherein the contact forces are oriented transversal to the effective direction of the pressing force.

BRIEF DESCRIPTION OF THE DRAWINGS

Further details and advantages of the invention are described based on embodiments with reference to drawing figures, where like numerals are used in for technically equivalent or identical components, wherein.

DETAILED DESCRIPTION OF THE INVENTION

Figure 1:
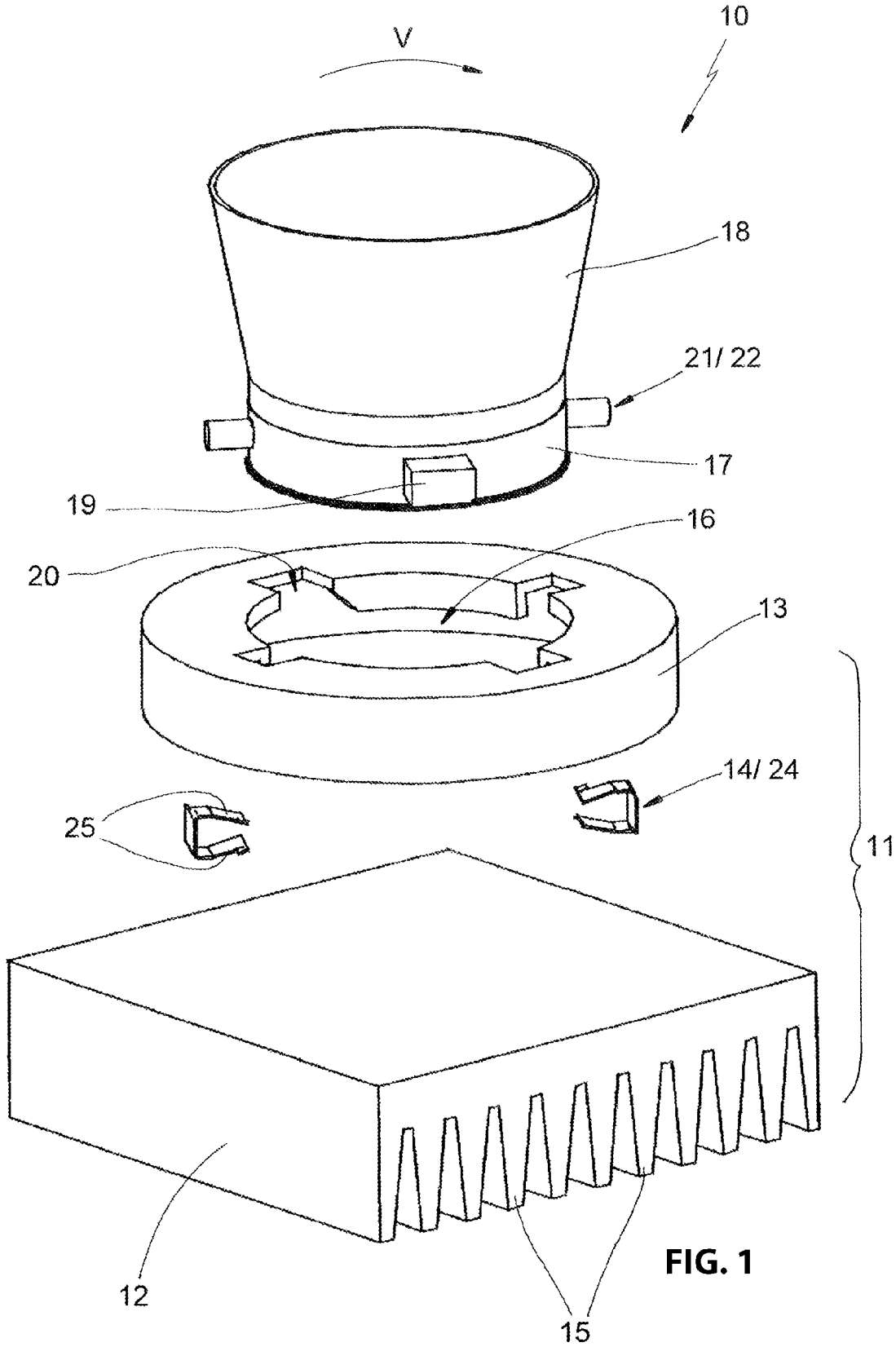
FIG. 1: illustrates an exploded view of the lamp socket and the lamp base according to the invention.

In the figures, an arrangement of lamp socket and lamp base is designated overall with the reference numeral 10.

A lamp socket 11 is illustrated which includes a cooling element 12 on which a socket housing 13 is arranged which is provided with socket contacts 14. The cooling element can also be an integral element, for example, of a lamp housing.

The surface of the cooling element 12 that is oriented towards the socket housing 13 is configured planar. The cooling element 12 is provided with a plurality of cooling ribs 15 on its bottom side arranged opposite to the socket housing 13 in order to increase the surface area and in order to improve heat dissipation.

The socket housing 13 includes a base receiver 16 which is configured in the present embodiment as a central circular recess. The lamp socket 17 includes optics 18 oriented away from the cooling element, wherein one or plural LEDs are arranged in a transition portion of the lamp base 17 and the optics 18. The lamp base 17 is configured in the embodiment with a contour that is congruent with the base receiver 16 and therefore configured as a circular cylinder. Support cams 19 radially protruding from the lamp socket 17 penetrate through locking grooves 20 when inserting the lamp base 17 into the socket housing 13 and reach behind accordingly configured wall sections of the socket housing 13 like a bayonet lock. In the first embodiment according to FIGS. 1 through 7, the base 17 includes radially protruding base contacts 21 configured as contact pins 22. The base contacts penetrate insertion grooves 23 when inserting the lamp base 17 into the socket housing 13 and thus move into the interior of the socket housing 13. When the lamp base 17 is turned in locking direction V and when reaching the end stop with respect to the bayonet type lock the contact pins 22 come into engagement with the socket contacts 14.

In the arrangement 10 including the lamp socket 11 and the lamp base 17, the lamp socket 11 is considered as a lower component and the lamp base 17 is considered as an upper component.

As can be derived from FIGS. 1 through 7, the socket contact 14 is configured as a contact clamp 24 with two contact arms 25 that are arranged opposite to one another and preloaded relative to one another.

Figure 2:
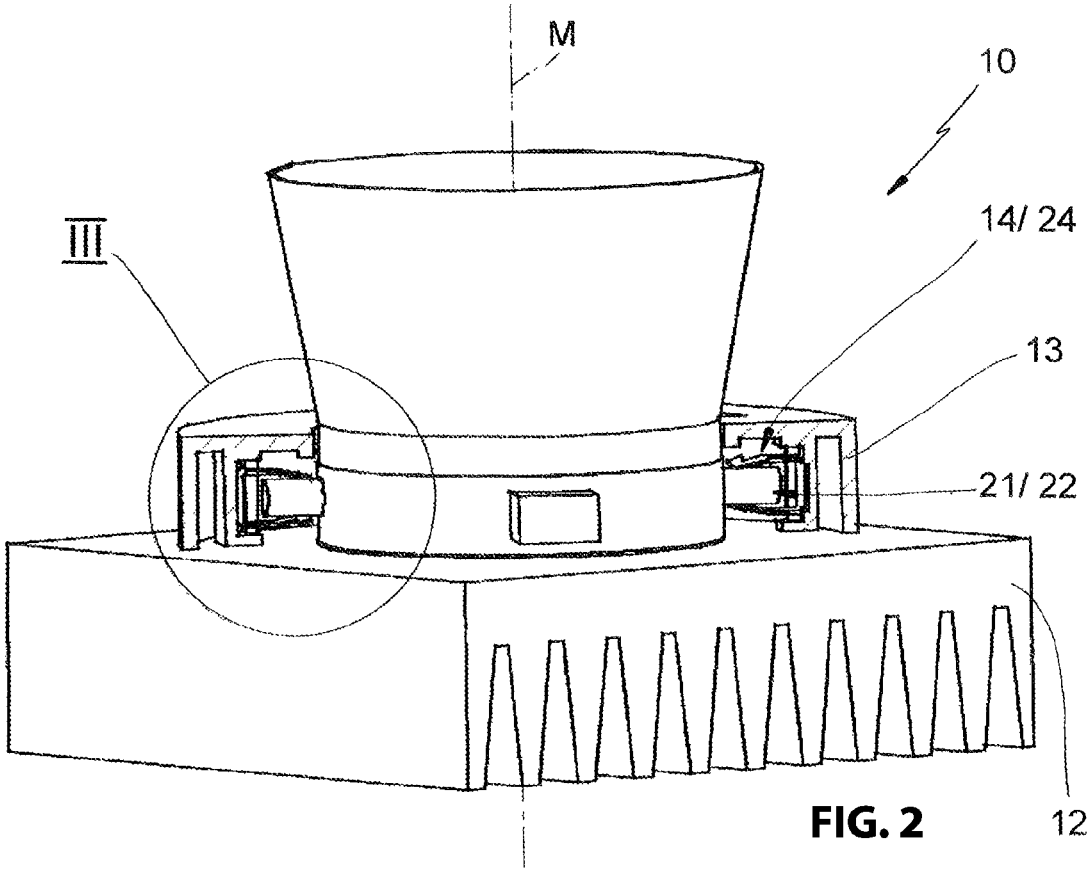
FIG. 2: illustrates a view according to FIG. 1 with a socket housing sectioned vertically in the plane of the base contacts.
Figure 3:
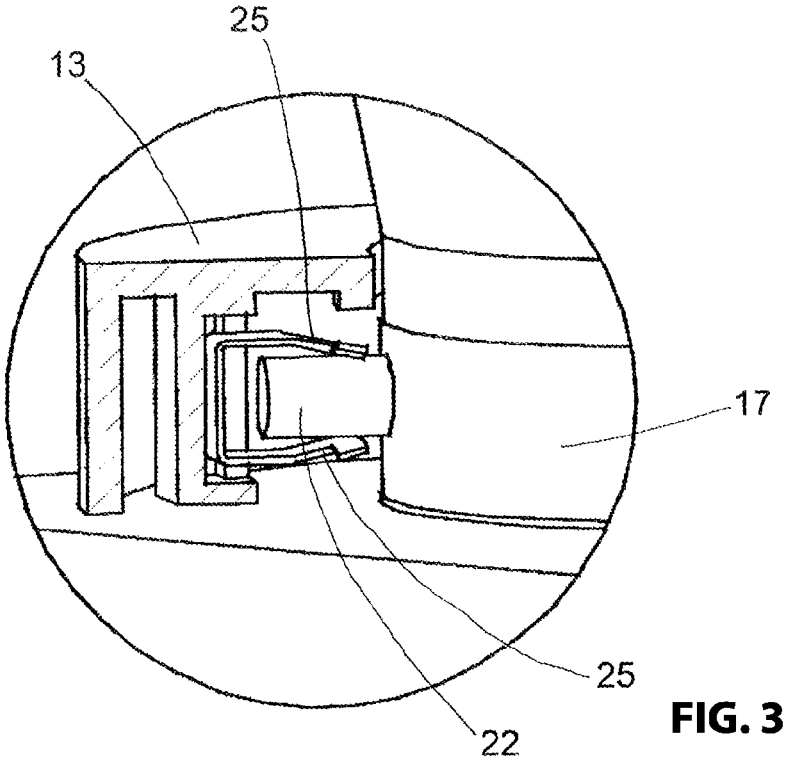
FIG. 3: illustrates a detail view according to the detail circle III in FIG. 2.
Figure 4:
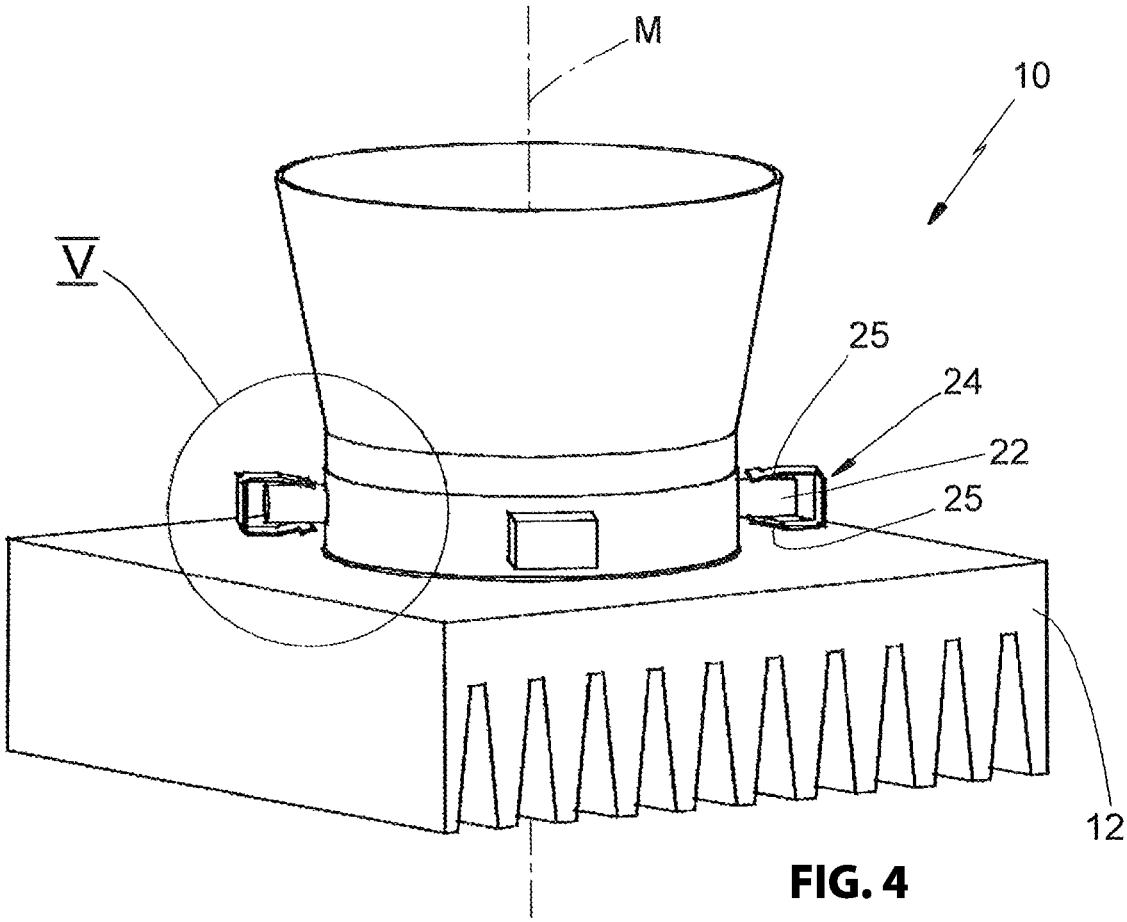
FIG. 4: illustrates a view according to FIG. 2 without the socket housing.
Figure 5:
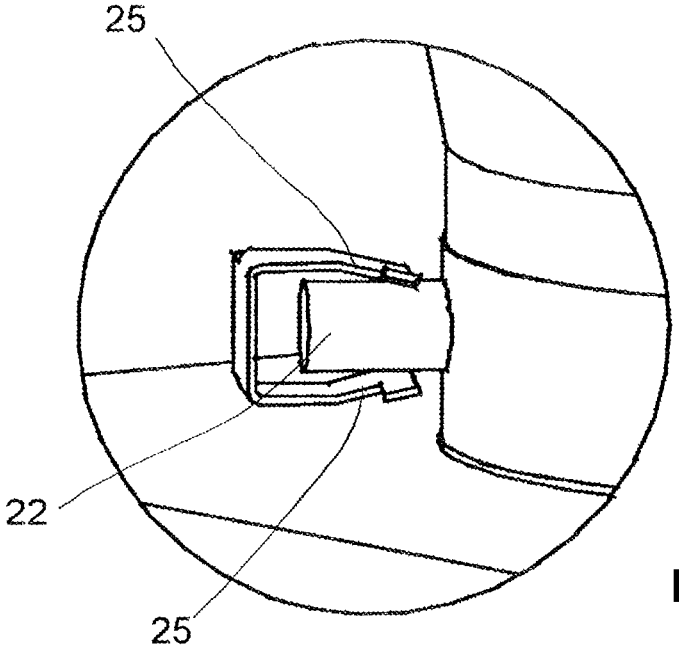
FIG. 5: illustrates a detail view according to detail circle V in FIG. 4.
Figure 6:
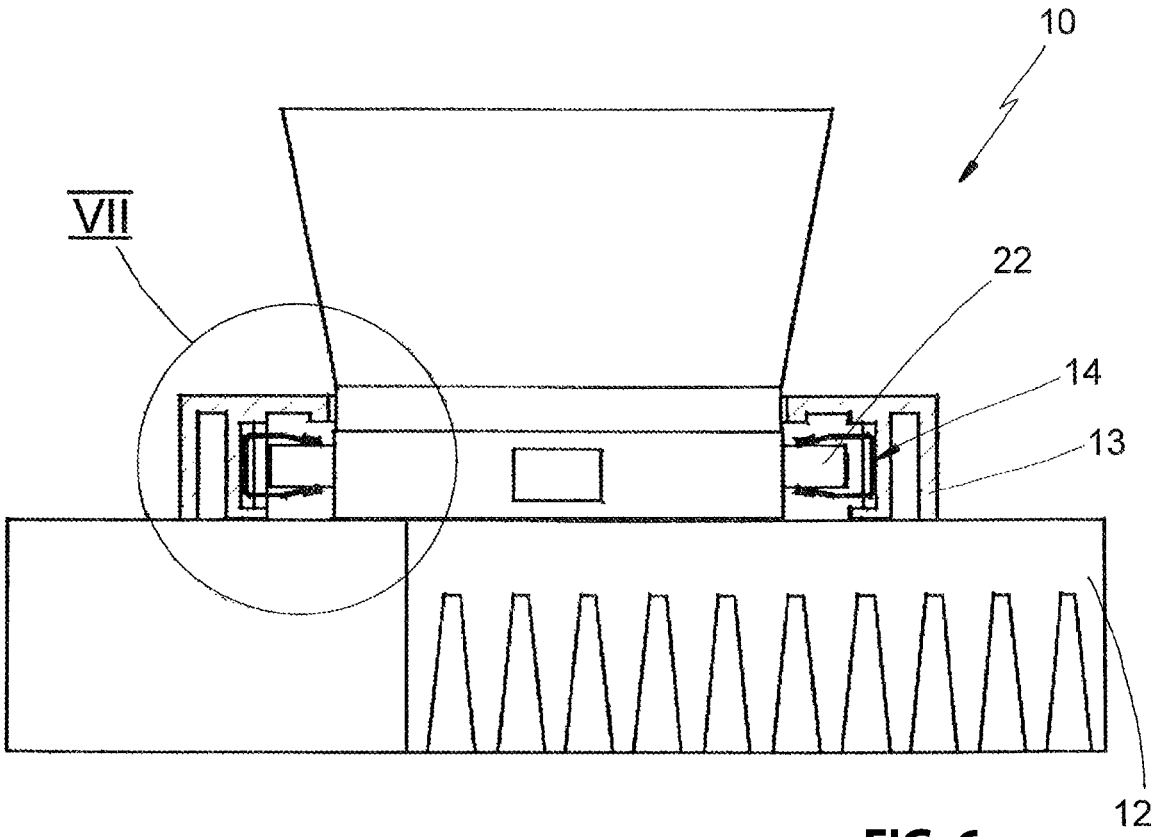
FIG. 6: illustrates a side view according to FIG. 2.
Figure 7:
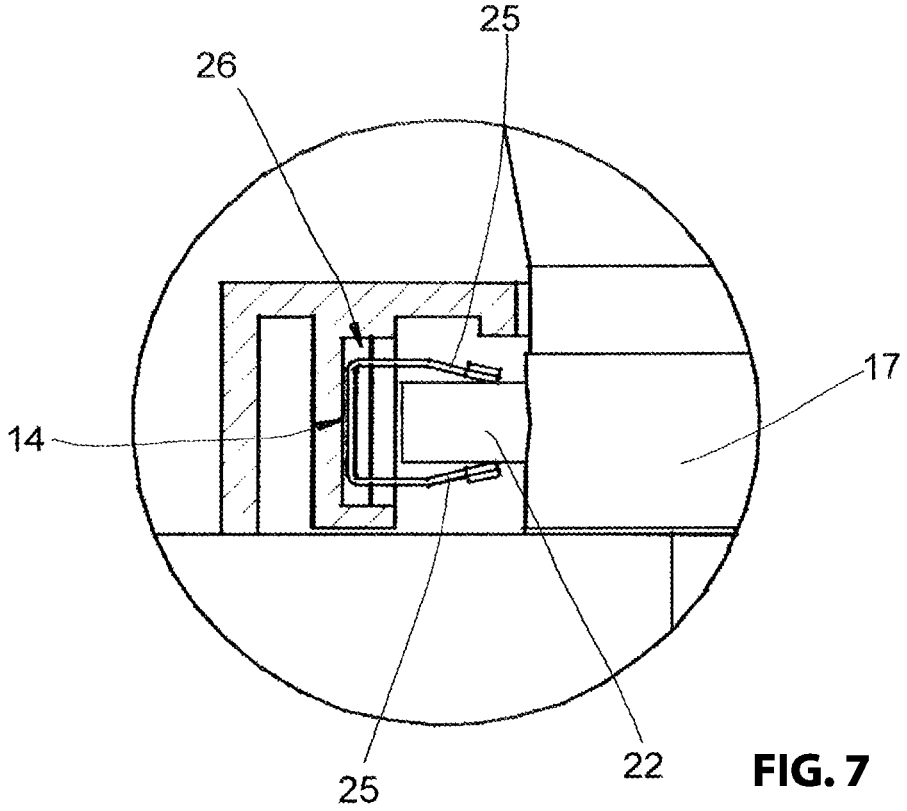
FIG. 7: illustrates a detail view according to the detail circle VII in FIG. 6.
Figure 8:
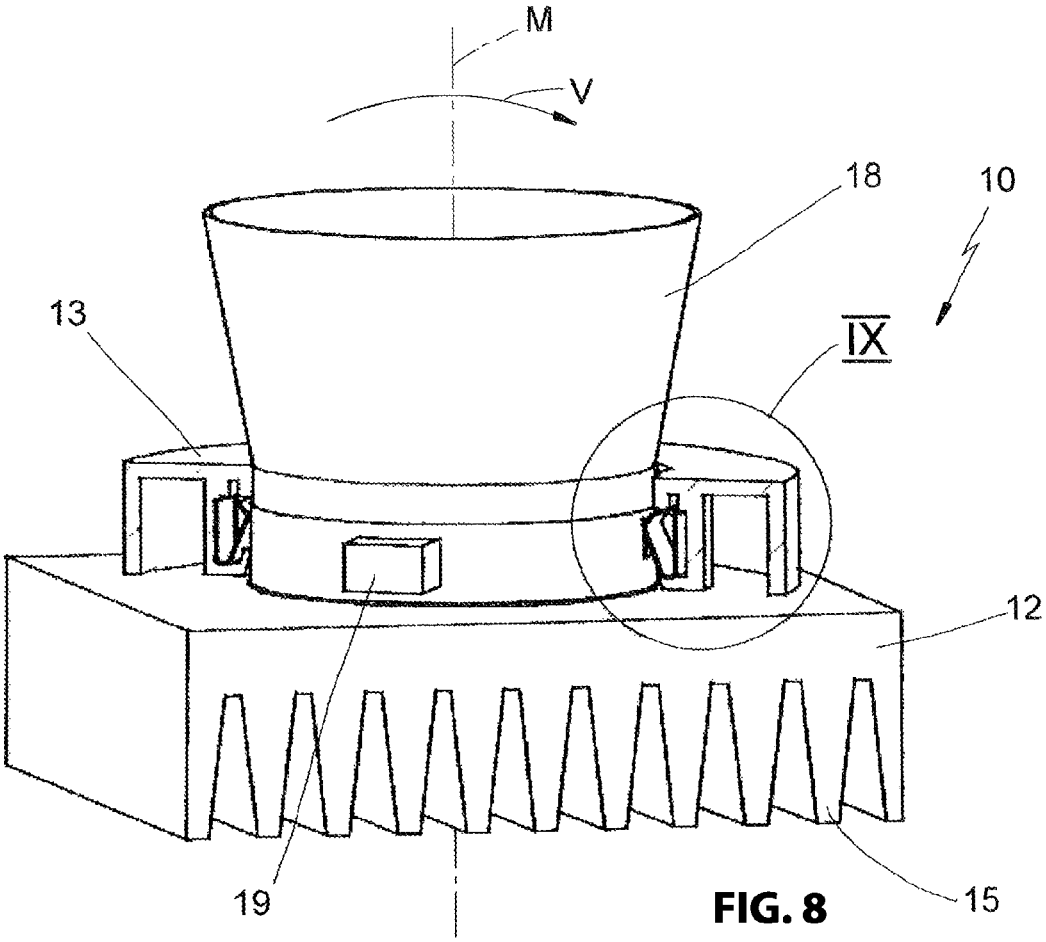
FIG. 8: illustrates a second embodiment of the invention in a perspective view with a socket housing that is vertically sectioned in the plane of the socket contacts.
Figure 9:
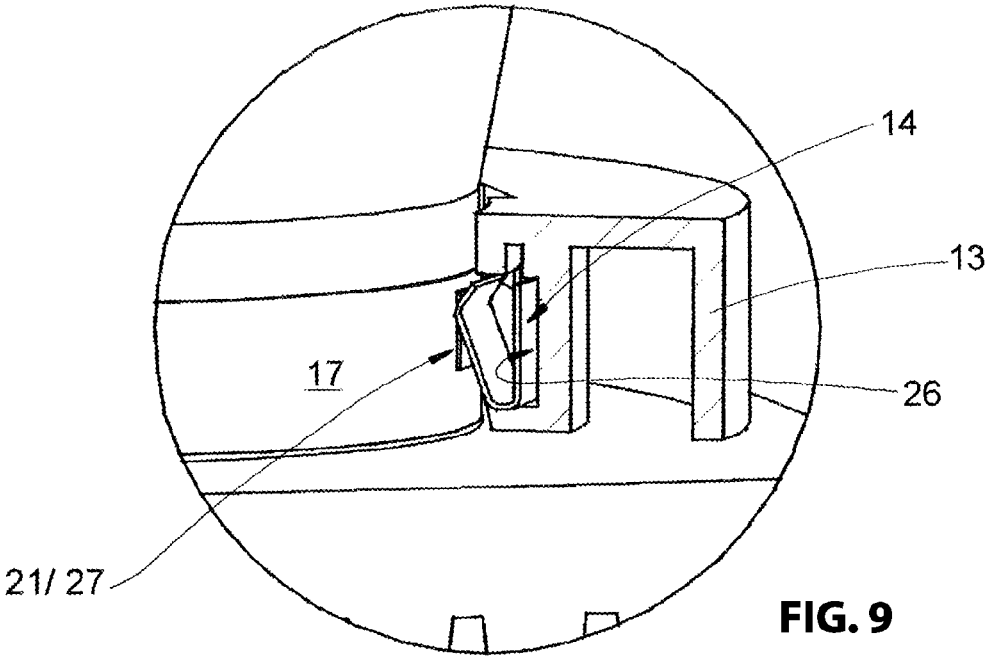
FIG. 9: illustrates a view according to the detail circle IX in FIG. 8.
Figure 10:
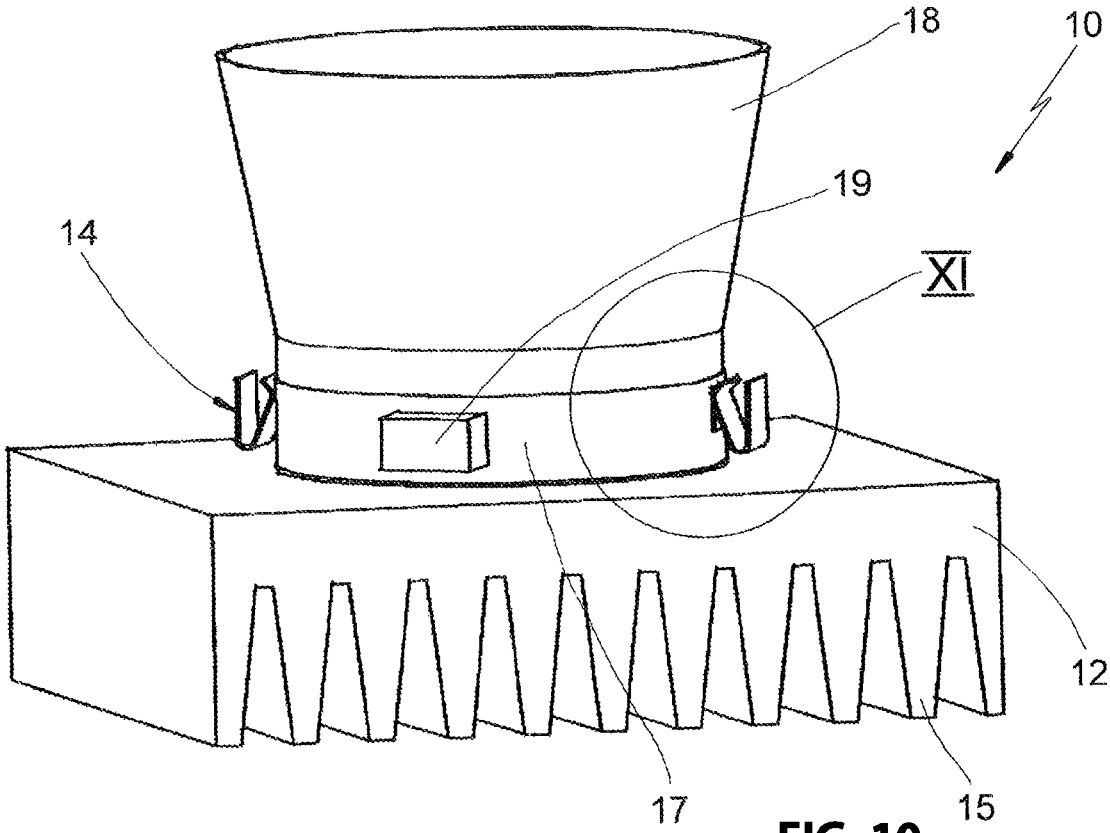
FIG. 10: illustrates a view according to FIG. 8 without the socket housing.
Figure 11:
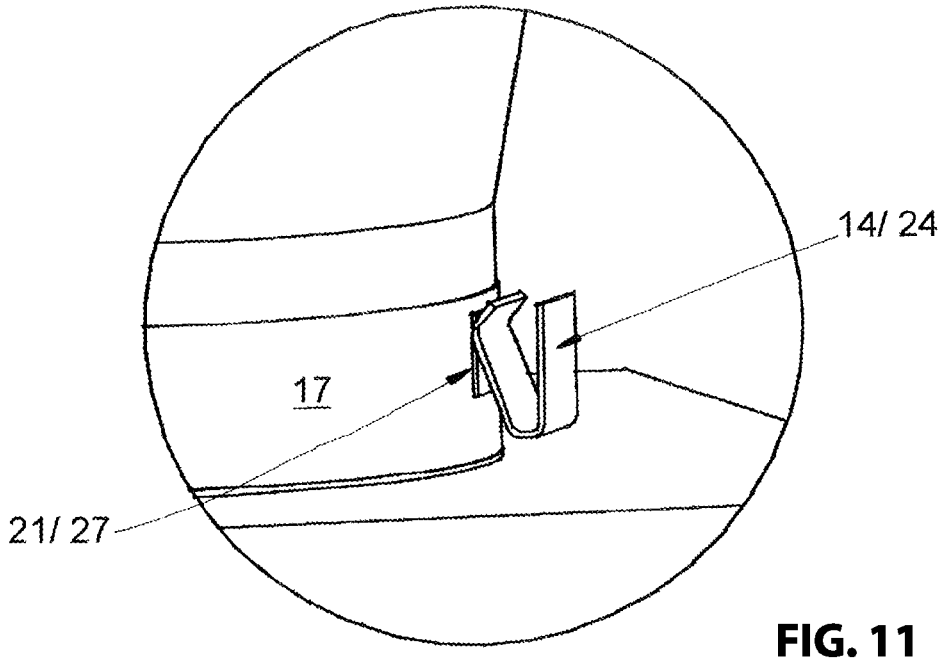
FIG. 11: illustrates a detail view according to the detail circle XI in FIG. 10.
Figure 12:
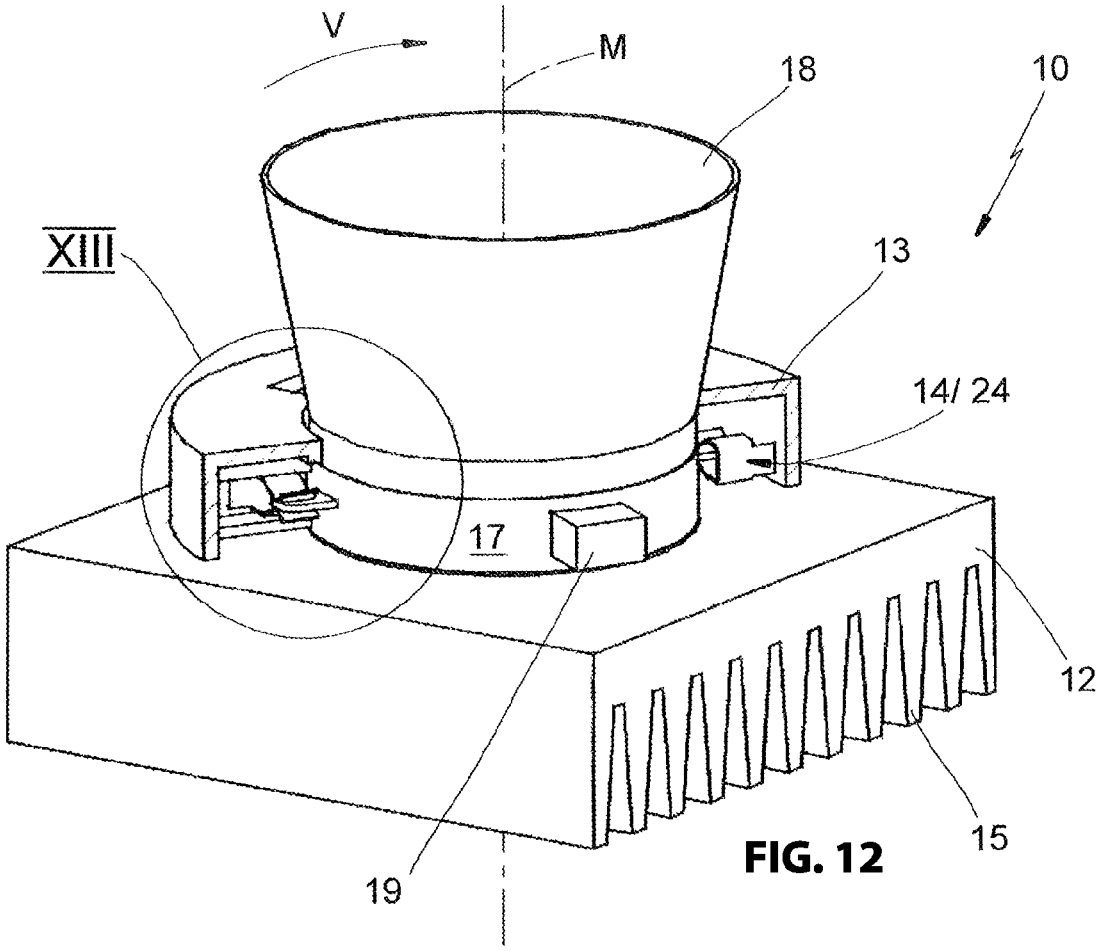
FIG. 12: illustrates another embodiment of the invention in a perspective view and an illustration of the socket housing in a vertical sectional view along a sectional plane through the socket contacts.
Figure 13:
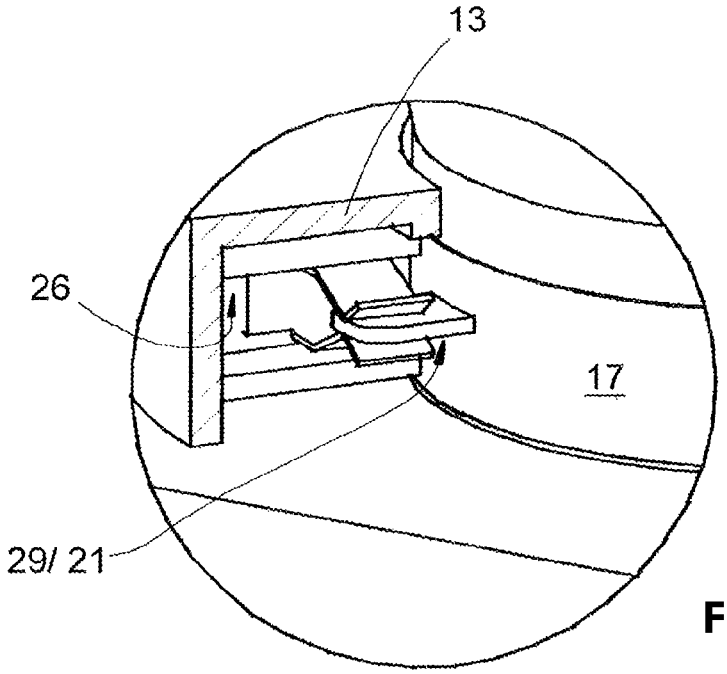
FIG. 13: illustrates a detail view according to the detail circle XIII in FIG. 12.
Figure 14:
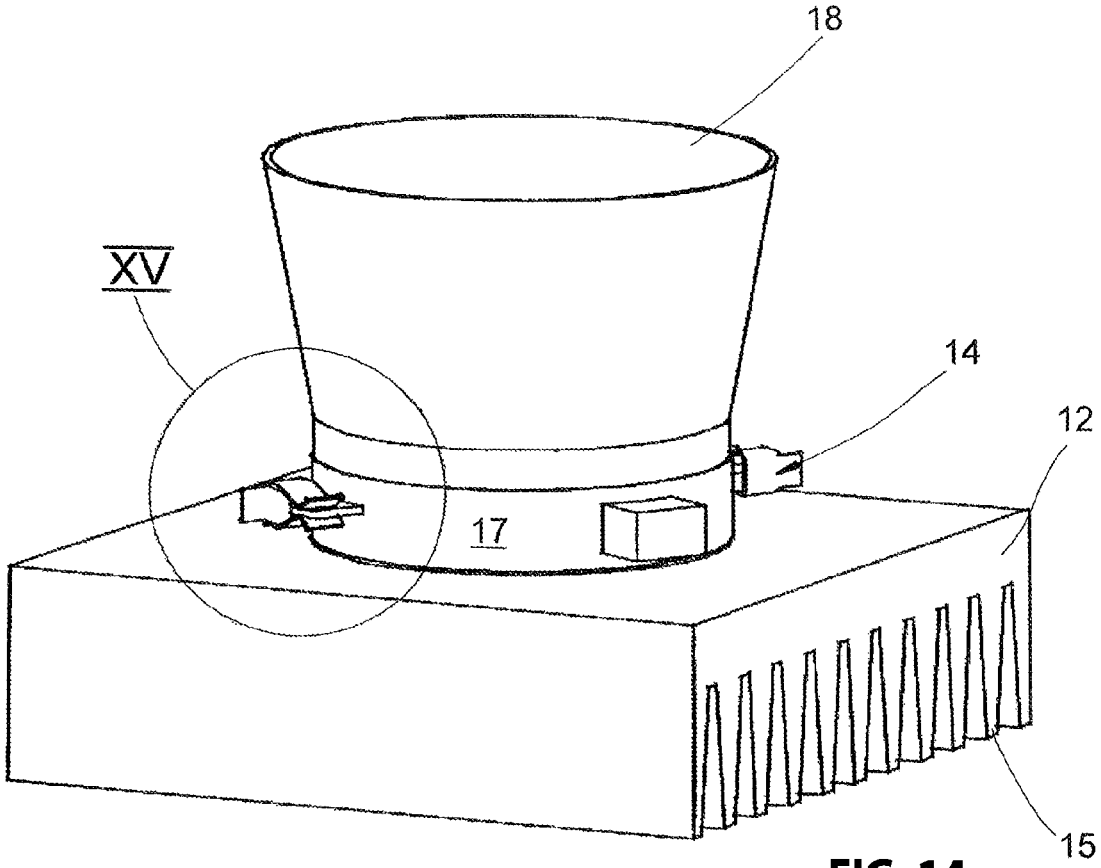
FIG. 14: illustrates a view according to FIG. 12 omitting the socket housing.
Figure 15:
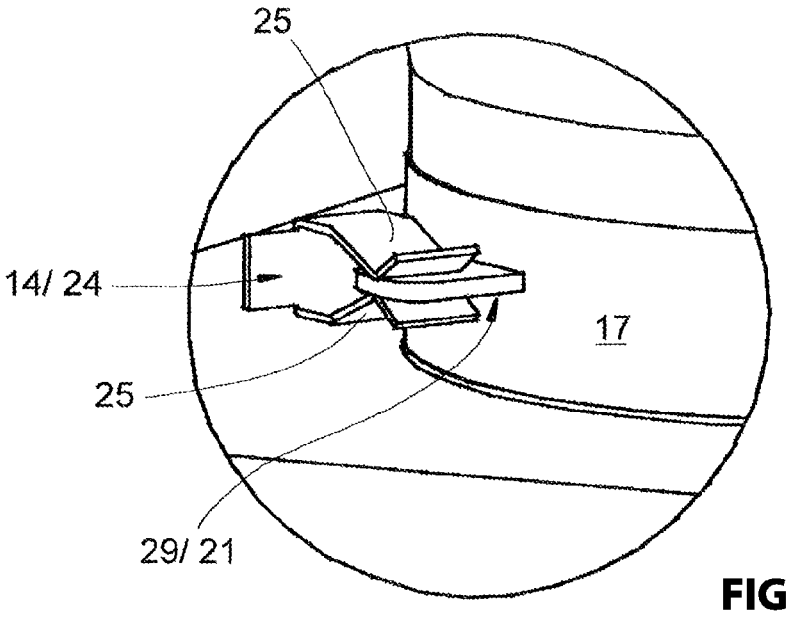
FIG. 15: illustrates a view according to the detail circle XV in FIG. 14.
Figure 16:
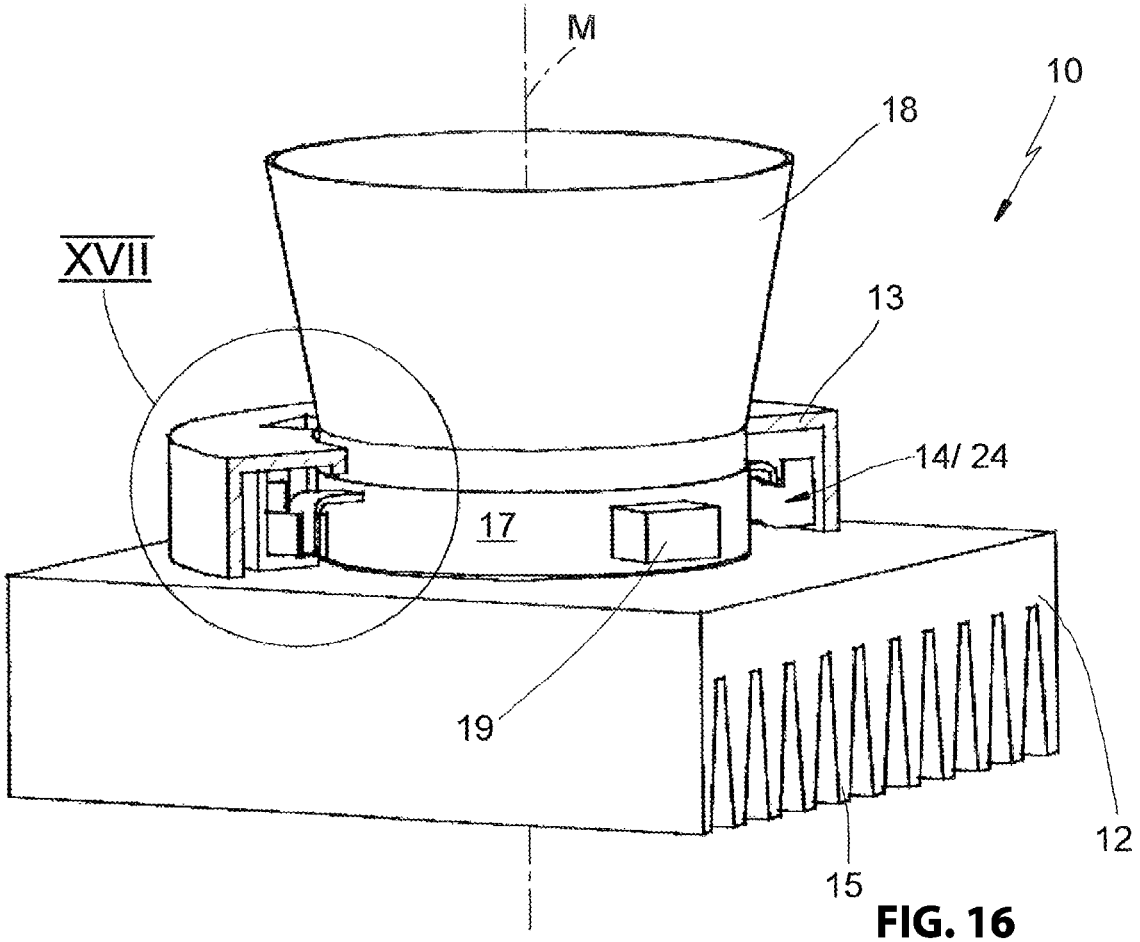
FIG. 16: illustrates another embodiment of the invention in a perspective view with a socket housing vertically sectioned in the plane of the socket contacts.
Figure 17:
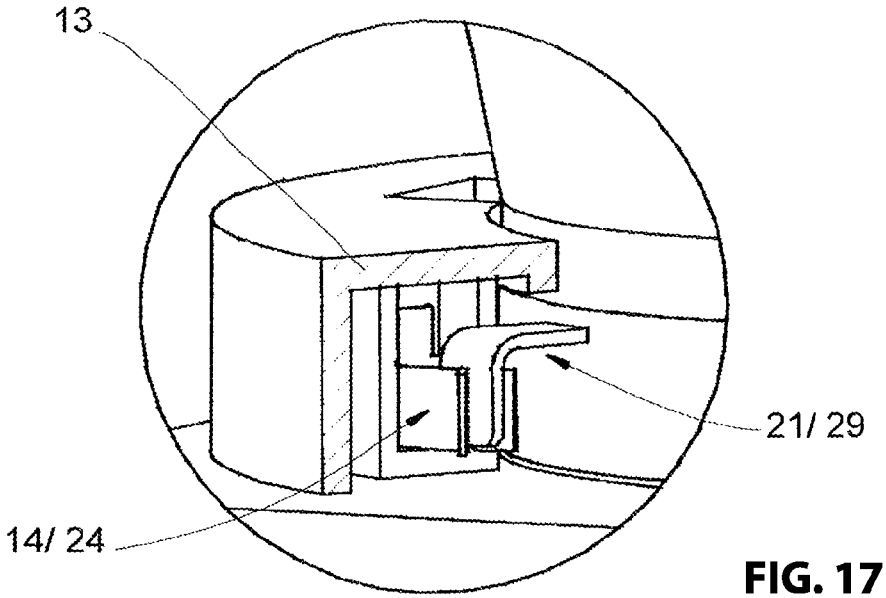
FIG. 17: illustrates a detail view according to the detail circle XVII in FIG. 16.
Figure 18:
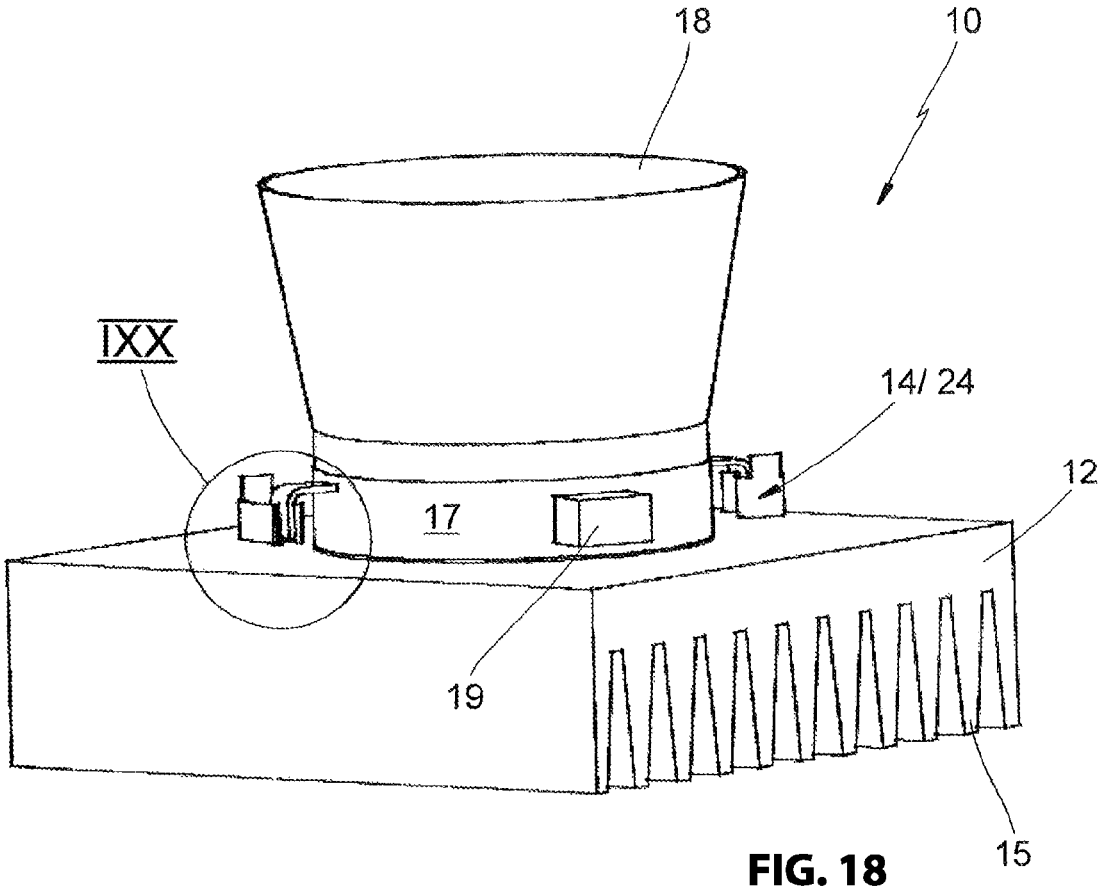
FIG. 18: illustrates a view according to FIG. 16 omitting the socket housing.
Figure 19:
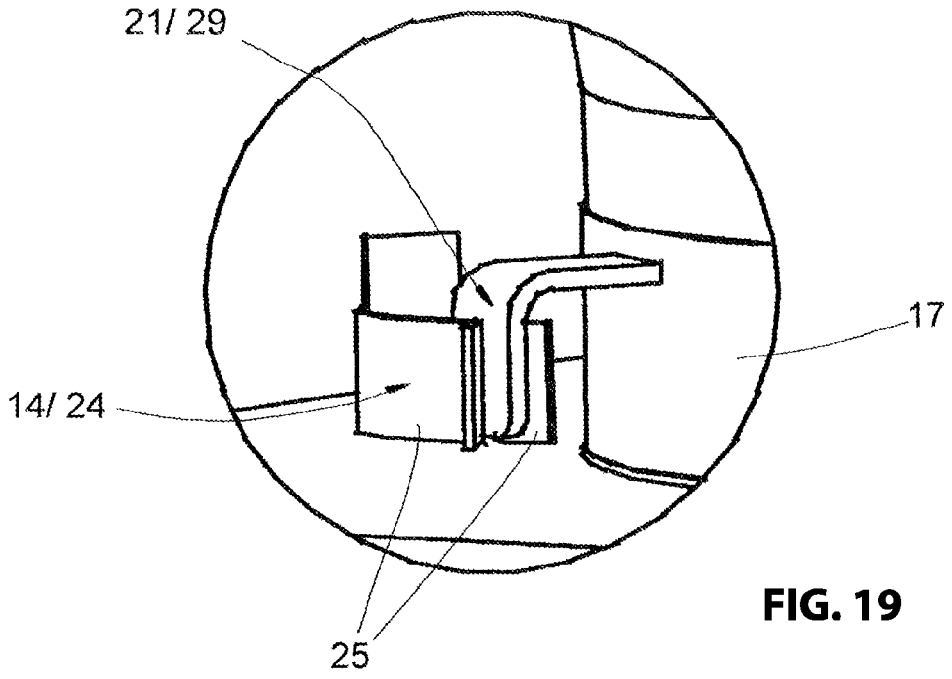
FIG. 19: illustrates a detail view according to the detail circle IXX in FIG. 18.

In FIG. 2, the arrangement 10 of lamp socket 11 and lamp base 17 is illustrated in its entirety again, wherein the socket housing 13 that is sectioned along a plane defined by the socket contacts 14 facilitates a view of the contact arrangement.

The lamp socket 17 supports a heat conducting element which is not designated in more detail which contacts on the one hand side the LED and when arranged in the socket 11 on the other hand side contacts the cooling element 12. This way, the heat generated through the operation of the illuminant is conducted away from the illuminant and dissipated through the cooling element 12 to the ambient. Thus it is required that the contact surfaces of the cooling element 12 and the base side heat conducting element contact one another with a particular minimum contact pressure. This minimum contact pressure is provided with a contact force which is generated by a device that is not illustrated. Typically, these are spring elements which load the lamp socket 11 and the lamp base 17 relative to one another. The contact pressure provides, possibly using additional devices improving heat transfer like heat transfer foil or heat transfer paste, a full surface even contact of the base side heat conducting element and the cooling element 12, and therefore provides optimum heat transfer.

In order to prevent negative influences upon the contact pressure or its even distribution through electrically contacting base and socket contacts, the invention provides solutions in the subsequently described embodiments, in particular with the described contact configuration and arrangement.

The socket contacts 14 configured as contact clamps 24 illustrated in FIGS. 1 through 7 contact the radially oriented outer surface of the contact pins 22 with its contact arms 25. The contact forces of the contact arms 25 thus act axially in a direction of the pressing force and also against the direction of the pressing force taking the longitudinal center axis M through the arrangement 10 as a reference. This is clearly apparent from FIGS. 3 through 5. In a contact arrangement of this type, there is a risk in principle that a force component of the lower contact arm 25 acting against the pressing force negatively influences the contact pressure, thus reduces the contact pressure. In order to prevent this, the socket contact 14 is supported in its contact cavity 26 axially movable, this means parallel to the center axis 14. Therefore, the socket contact 14 in a first embodiment according to FIGS. 1 through 7 cannot be supported in axial direction; this means parallel to the effective direction of the pressing force at the socket housing. An opposite force can in particular not be applied through the lower contact arm 25 against the effective direction of the contact force. The force component oriented against the pressing force between lamp socket 11 and lamp base 17 can therefore be used exclusively for a safe contact between the socket contact 14 and the contact pin 22, but cannot negatively influence the contact pressure between the cooling element 12 and the base side heat conducting element. The clearance of the socket contact 14 in its contact cavity 26 is sized so that all possibly occurring axial dimensional tolerances at the base 11 and the socket 17 can be bridged/compensated without any force.

A second advantageous embodiment of the invention is illustrated in FIGS. 8 through 11. The socket contacts 14 are thus configured as approximately V-shaped contacts and are arranged in vertical direction, this means in the direction of the vertical center axis M without clearance in the contact cavity 26 formed by the socket housing 13. The lamp base 17 forms radially outward oriented contact fields 27 which move in locking direction V after insertion of the lamp base 17 into the lamp socket 11 and contact the V-shaped socket contact 14. A spring loaded arm 28 of the V-shaped socket contact contacts the contact field 27 for providing an electrical contact. The contact forces imparted by the spring arm 28 are essentially oriented in radial direction towards the lamp socket 17 or transversal to the vertical center axis M or transversal to the effective direction of the contact force. A negative influence of the contact force between the base side heat conducting element and the cooling element 12 is therefore not provided.

A third embodiment of the invention is illustrated in FIGS. 12 through 15. This is a lamp socket 17 which forms radially protruding flat blade contacts 29 which are in turn configured by socket contacts 14 configured as contact clamps 24 with contact arms 25 acting against one another. Thus, the statements made regarding FIGS. 1 through 7 also apply; in particular the socket contact 14 is supported also here parallel to the vertical center axis M or parallel to the effective direction of the contact force in a floating manner in the contact cavity 26.

Another embodiment of the invention is illustrated in FIGS. 16 through 19. These FIGs. illustrate a lamp base 17 with flat blade contacts which initially radially protrude with a section from the base but transition into an end section that is angled by 90° towards the cooling element 12 and thus oriented parallel to the vertical center axis or relative to the effective direction of the contact force. A socket contact 14 configured as a contact clamps 24 reaches around the angled end section of the flat blade contact 29 on both sides. Due to the arrangement of the end section of the flat blade contact 29, the contact forces between the contact arms 25 and the angled end section of the flat blade contact 29 inserted between the contact arms are oriented transversal to the vertical center axis M and thus transversal to the effective direction of the pressing force between the base side heat conducting element and the cooling element 12. Thus, the contact forces do not have any influence at all upon the contact pressure or its even distribution between cooling element 12 and the base side heat conducting element.

Subsequently, the invention is also described in more detail with reference to FIGS. 20 through 23. For the embodiments according to FIGS. 20 through 23, like numerals are used for identical or technically equivalent components. The arrow directions define the effective direction of the respective forces.

An arrangement of lamp socket and lamp base is illustrated which is overall provided with the reference numeral 40. The lamp socket 42 includes a cooling element 43, a socket housing which is not illustrated and socket contacts 44.

The lamp base overall designated with reference numeral 41 includes a base housing 45, wherein a heat conducting element 47 is arranged at the bottom side 46 of the base housing which is oriented towards the cooling element 43. The heat conducting element 47 contacts the cooling element 43 with a particular contact pressure $F_A$, optionally with a heat transfer paste or a heat transfer foil arranged there between. The contact pressure $F_A$ is generated by a device which is not illustrated in more detail which can include, for example, spring elements which clamp the lamp base 41 together with the cooling element 43. In the embodiments according to FIGS. 20 through 23, the effective direction of the force corresponds to the arrow direction. The force therefore impacts the lamp socket 41 and presses the lamp socket in a direction towards the cooling element 43 and is oriented in the particular embodiment vertical to the upper side of the cooling element 48 oriented towards the lamp base 41. Other embodiments are conceivable. In particular the force effective direction can also be oriented against the illustration in FIGS. 20 through 23 which only represents a reversal of the principle of the invention described infra. The contact pressure between the cooling element 43 and the heat conducting element 47 is evenly distributed over the respective contact surfaces.

The even contact pressure that is generated through the contact force $F_A$ between the heat conducting element 47 and the cooling element 43 provides optimum transfer of the heat generated by the LED 49 during operation. Thus, the LED contacts the heat conducting element 47 supported in the base housing 45.

It is an important principle of the invention to configure the contact between the socket contacts 44 and the base contacts 50 through an appropriately selected contact configuration and/or appropriately selected contact support in the lamp base 41 or in the lamp socket 42 without an opposite force to the contact force $F_A$. This means that the contact forces $F_K$ between the base contacts 50 supported by the lamp base and the socket contacts 44 which provide secure power supply for the LEDs do not have any force component which acts against the contact force $F_A$.

Figure 20:
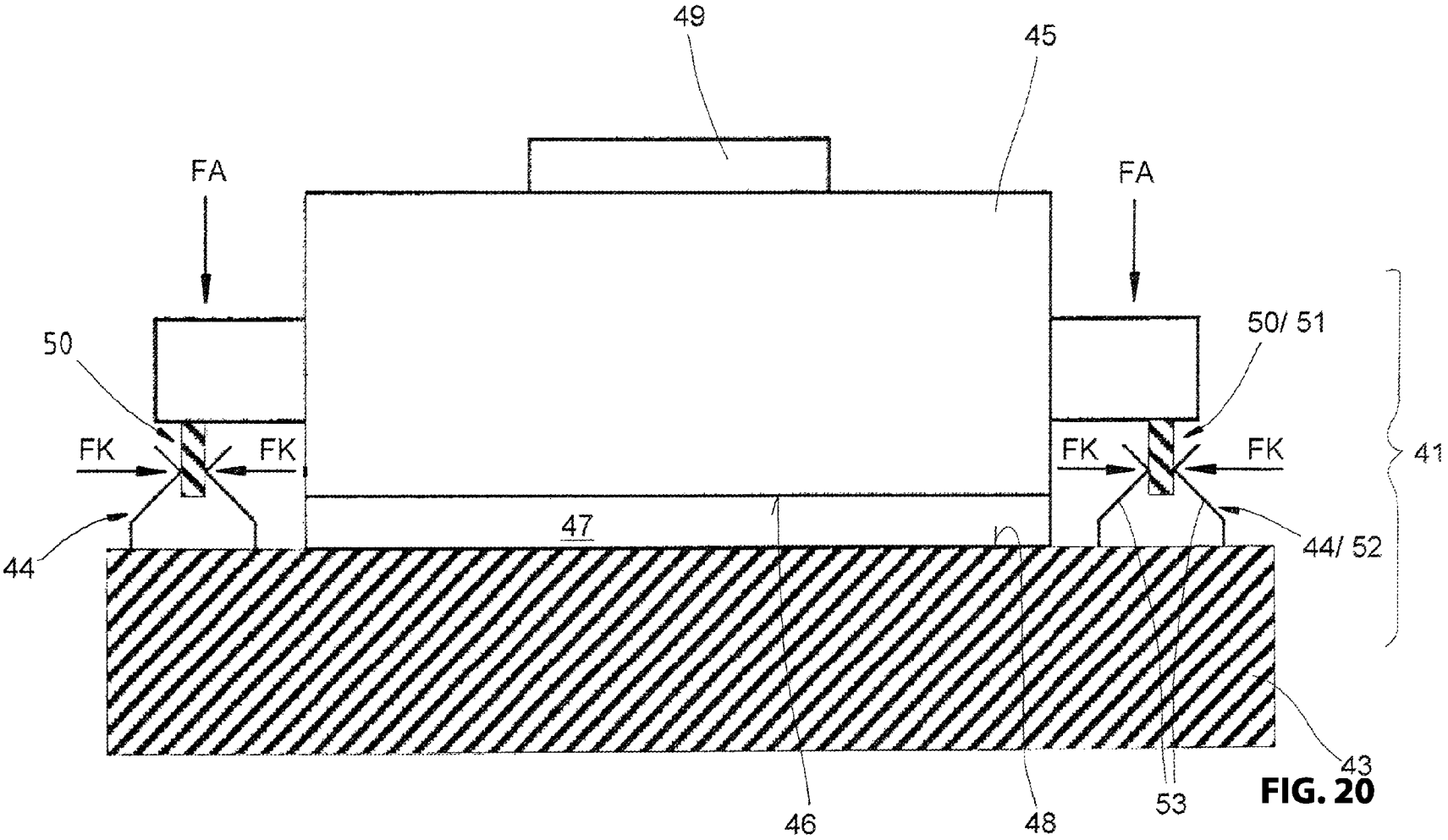
FIGS. 20 through 23: illustrate schematic views of additional embodiments of the invention depicting force effective directions.

FIG. 20 illustrates a contact arrangement of socket contact 44 and base contact 50 in which the base contact is configured as a contact pin 51 and the socket contact is configured as a contact clamp 52. The contact clamp 52 includes two contact arms 53 that are oriented against one another and receive the contact pin 51 between one another.

The base contact 50 is oriented parallel to the effective direction of the contact force $F_A$ in a direction towards the cooling element 43. The contact arms 53 of the socket contact 44 are oriented in the same direction. The contact forces $F_K$ act substantially transversally to the pressing force $F_A$.

Figure 21:
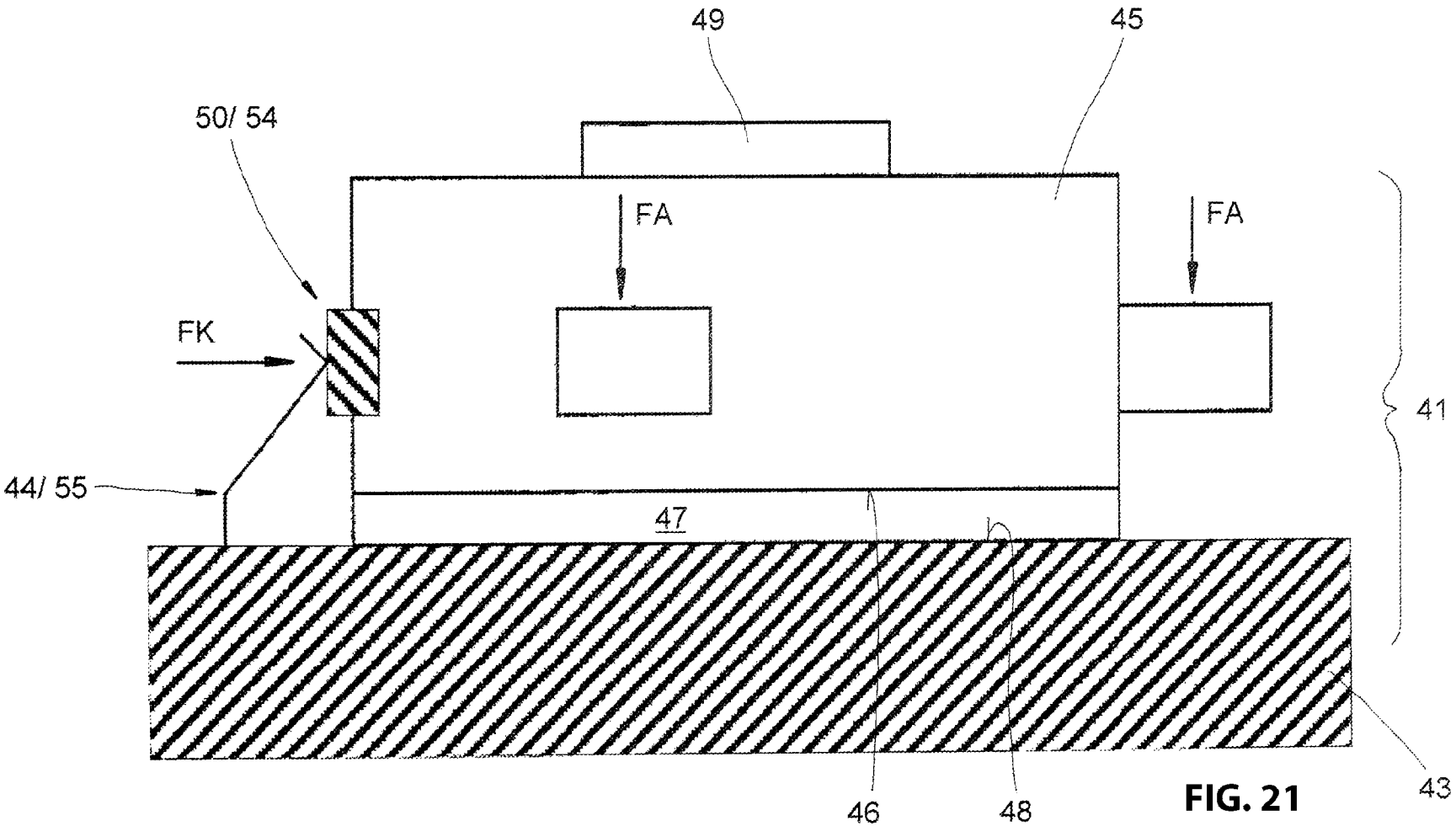

An alternative embodiment is illustrated in FIG. 21. The base housing 45 is provided on its outer circumference with a base contact 50 configured as a contact field 54. The socket contact 44 configured as a spring arm 55 that is preloaded in a direction towards the base housing contacts the contact field 54 through a contact force $F_K$ oriented transversal to the pressing force $F_A$. Also this embodiment provides electric contacting without an opposite force to the pressing force.

Figure 22:
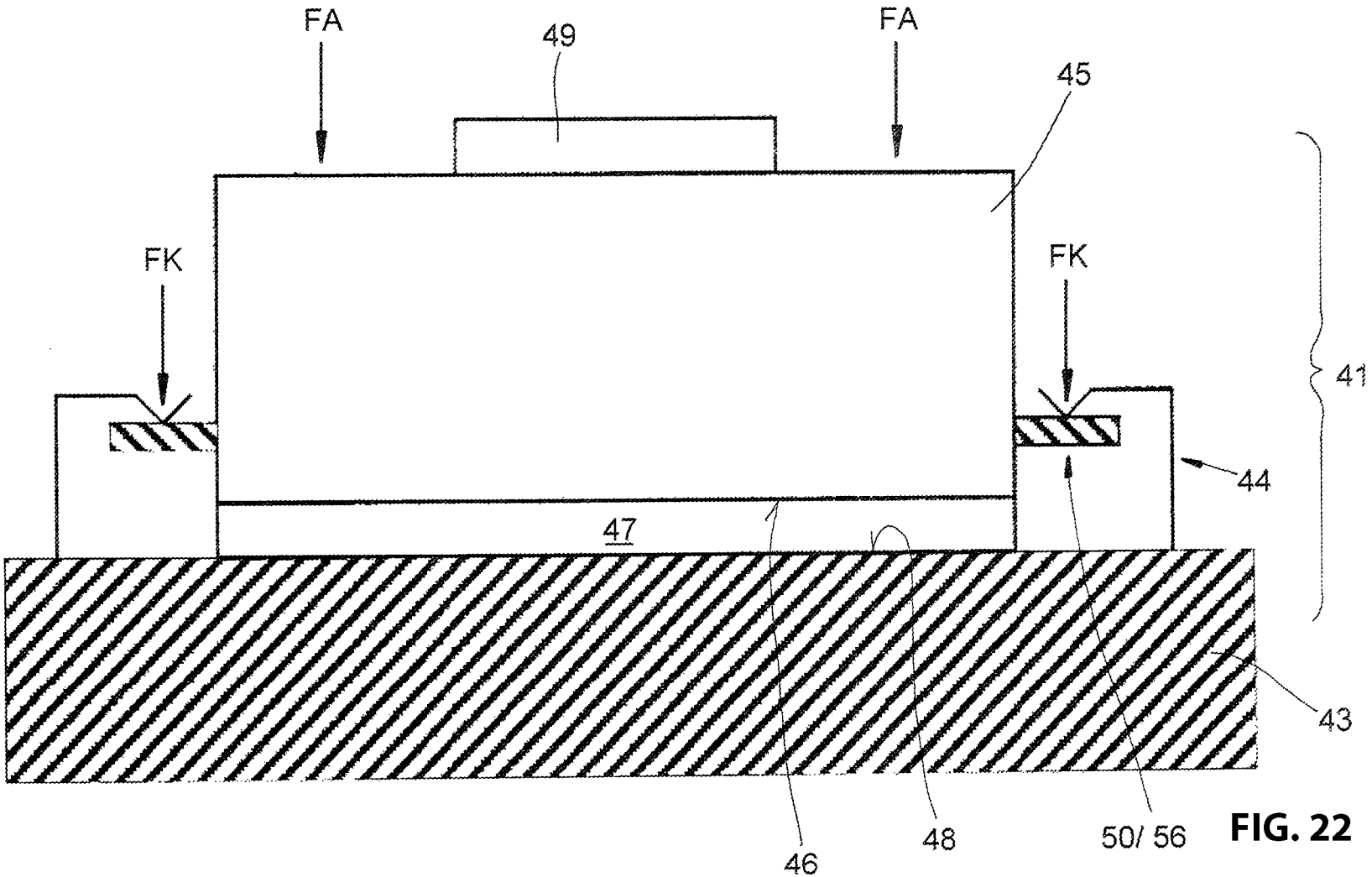

The embodiment of the invention illustrated in FIG. 22 includes another very advantageous arrangement of socket contacts 44 and base contacts 50.

The base contacts 50 protrude relative to the circumferential surface of the base housing 45, thus they are radially oriented. In particular they are flat blade contacts 56. These flat blade contacts 46 oriented transversal to the effective direction of the pressing force $F_A$ are contacted by the socket contacts 44 on a top sides of the flat blade contacts, thus on the side oriented away from the cooling element 43. Consequently, the effective direction of the contact forces $F_K$ is identical with the effective direction of the pressing force $F_A$. In this embodiment, the contact forces $F_K$ therefore reinforce the contact pressure between the heat conducting element 47 and the cooling element 43 when the flat blade contacts 46 are evenly spaced along a circumference.

Figure 23:
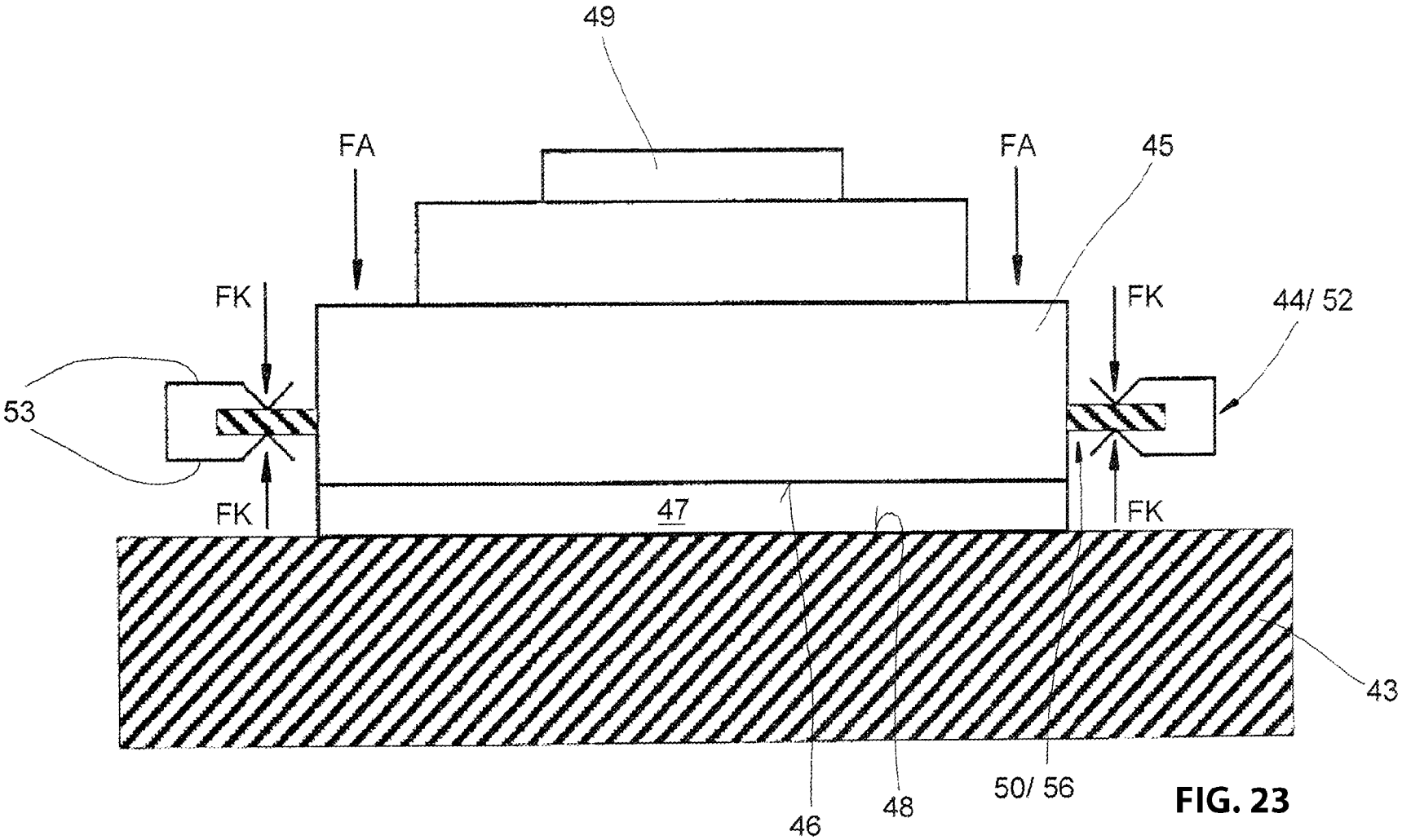

The last embodiment of the invention is illustrated in FIG. 23. Also here the base contacts 50 in turn are configured as circumferentially protruding or radially oriented flat blade contacts 56. The socket contacts, however, are configured as contact clamps whose contact arms 53 contact the flat blade contacts 56 at opposite sides and contact them electrically at least on one side. In the embodiment, a first contact arm 53 like already in FIG. 22 contacts the top side of the flat blade contact 56 that is oriented away from the cooling element 43, the second contact arm 53 contacts the bottom side of the flat blade contact at an opposite side of the flat blade contact that is oriented towards the cooling element 43. This contact arrangement due to the two-sided contact of the contact arms 53 at the flat blade contact 56 has substantial advantages with respect to contact safety which furthermore also apply to the embodiment according to FIG. 20.

As can be derived from FIG. 23, the contact forces act between the flat blade contact 56 and the lower contact arm 53 adjacent to the cooling element 43 against the pressing force $F_A$. As a matter of principle, this force component is configured to act against the pressing force $F_A$ and to reduce the contact force between the cooling element 43 and the heat conducting element 47 which is important for the heat transfer in a disadvantageous manner. In order to prevent this, the socket contact 44 is supported parallel to the effective direction of the pressing force $F_A$ so that it is movable in the socket housing. Consequently, the force component oriented against the effective direction of the pressing force cannot become effective.

To sum it all up, the invention illustrates various contact configurations and contact arrangements of the socket and base contacts 44, 50, 14, 21 whose contact forces $F_K$ act without opposite force with respect to the pressing force $F_A$. This is provided in particular in that the contacts are arranged relative to one another so that the contact forces are mostly aligned transversal to the pressing force or in the effective direction of the pressing force. However, when the contact arrangement includes a contact force component that is oriented against the effective direction of the pressing force, the contacts of the lamp socket 42, 11 and/or the lamp base 42, 17 have to be supported in a decoupled manner. Then this force component cannot develop an effect that is opposite to the pressing force $F_A$.

REFERENCE NUMERALS AND DESIGNATIONS

10 Arrangement of lamp socket and lamp base
11 Lamp socket
12 Cooling element
13 Socket housing
14 Socket contact
15 Cooling ribs
16 Base receiver
17 Lamp base
18 Optics
19 Support cam
20 Locking groove of 13
21 Base contact
22 Contact pin
23 Insertion groove of 13
24 Contact clamp
25 Contact arm of 24
26 Contact cavity
27 Contact field
28 Spring arm
29 Flat blade contact
40 Arrangement of lamp socket and lamp base
41 Lamp base
42 Lamp socket
43 Cooling element
44 Socket contacts
45 Base housing
46 Bottom side of 45
47 Heat conducting element
48 Top side
49 LED
50 Base contact
51 Contact pin
52 Contact clamp

53 Contact arm
54 Contact field of 45
55 Spring arm of 44
56 Flat blade contacts
$F_A$ Pressing force
$F_K$ Contact forces
M Vertical center axis of 10
V Locking device

What is claimed is:

1. A lamp socket for supporting a light source provided with a LED, the lamp socket comprising:

a cooling element;

a socket housing which includes socket contacts for electrically connecting a light source; and a lamp base which supports a LED connected to a heat conducting element and is insertable in the socket housing and includes base contacts which are connectable with the socket contacts through a contact force for providing power to the LED, wherein the cooling element on a socket side is connected with the heat conducting element on a base side through a contact pressure that promotes heat transfer, wherein the contact pressure is provided through a pressing force generated by preloading the socket contacts in order for the cooling element to absorb heat generated by the LED during operation, wherein the electrical connection between the socket contacts and the base contacts is provided through a contact configuration or a contact support that does not provide forces opposite to the pressing force, wherein contact fields are configured at the socket or at the base, wherein the base contacts or the socket contacts contact the contact fields, and wherein the contact forces are oriented in a direction that is transversal to the effective direction of the pressing force, wherein the electrical connection between the socket contacts and the base contacts is provided in a manner that increases the pressing force.

2. The lamp socket according to claim 1, wherein the contact force between the socket contacts and the base contacts includes a force component oriented in the effective direction of the pressing force and that does not influence an even distribution of the contact pressure.

3. A lamp socket for supporting a light source provided with an LED, the lamp socket comprising:

a cooling element;

a socket housing which includes socket contacts for electrically connecting a light source; and a lamp base which supports an LED connected to a heat conducting element and is insertable in the socket housing and includes base contacts which are connectable with the socket contacts through a contact force for providing power to the LED, wherein the cooling element on a socket side is connected with the heat conducting element on a base side through a contact pressure that promotes heat transfer, wherein the contact pressure is provided through a pressing force generated by preloading the socket contacts in order for the cooling element to absorb heat generated by the LED during operation, wherein the base contacts are configured as contacts that protrude from the base in a direction towards the cooling element, wherein the contact force between the socket contacts and the base contacts is oriented substantially transversal to an effective direction of the pressing force and wherein the electrical connection between the socket contacts and the base contacts is provided through a contact configuration or a contact support that does not provide forces opposite to the pressing force, and wherein the socket contacts are configured as contact clamps which support the base contacts between two contact arms.

4. A lamp socket for supporting a light source provided with a LED, the lamp socket comprising:

a cooling element;

a socket housing which includes socket contacts for electrically connecting a light source; and a lamp base which supports a LED connected to a heat conducting element and is insertable in the socket housing and includes base contacts which are connectable with the socket contacts through a contact force for providing power to the LED, wherein the cooling element on a socket side is connected with the heat conducting element on a base side through a contact pressure that promotes heat transfer, wherein the contact pressure is provided through a pressing force generated by preloading the socket contacts in order for the cooling element to absorb heat generated by the LED during operation, wherein the electrical connection between the socket contacts and the base contacts is provided through a contact configuration or a contact support that does not provide forces opposite to the pressing force, wherein contact fields are configured at the socket or at the base, wherein the base contacts or the socket contacts contact the contact fields, and wherein the contact forces are oriented in a direction that is transversal to the effective direction of the pressing force, wherein the base contacts are configured as contacts which protrude laterally from the base circumference and the contact forces between the socket contacts and the base contacts essentially have the same effective direction as the pressing force.

5. The lamp socket according to claim 4, wherein the socket contacts are configured as contact clamps which receive the base contacts, and wherein the socket contacts are supported parallel to the effective direction of the pressing force so that they float in the socket housing and/or the base contacts are supported parallel to the effective direction of the pressing force so that they float in the lamp base.

6. The lamp socket according to claim 4, wherein the base contacts are oriented in a direction that is transversal to the effective direction of the pressing force.

7. The lamp socket according to claim 6, wherein the base contacts are flat blade contacts.

8. A lamp socket for supporting a light source provided with an LED, the lamp socket comprising:

a cooling element;

a socket housing which includes socket contacts for electrically connecting a light source; and a lamp base which supports an LED connected to a heat conducting element and is insertable in the socket housing and includes base contacts which are connectable with the socket contacts through a contact force for providing power to the LED, wherein the cooling element on a socket side is connected with the heat conducting element on a base side through a contact pressure that promotes heat transfer, wherein the contact pressure is provided through a pressing force generated by preloading the socket contacts in order for the cooling element to absorb heat generated by the LED during operation, wherein the electrical connection between the socket contacts and the base contacts is provided through a contact configuration or a contact support that does not provide forces opposite to the pressing force, wherein the electrical connection between the socket contacts and the base contacts is provided in a manner that increases the pressing force, and wherein the base contacts are configured as contacts which protrude laterally from the base circumference, and the contact forces between the socket contacts and the base contacts essentially have the same effective direction as the pressing force.

9. A lamp socket for supporting a light source provided with an LED, the lamp socket comprising:

a cooling element;

a socket housing which includes socket contacts for electrically connecting a light source; and a lamp base which supports an LED connected to a heat conducting element and is insertable in the socket housing and includes base contacts which are connectable with the socket contacts through a contact force for providing power to the LED, wherein the cooling element on a socket side is connected with the heat conducting element on a base side through a contact pressure that promotes heat transfer, wherein the contact pressure is provided through a pressing force generated by preloading the socket contacts in order for the cooling element to absorb heat generated by the LED during operation, and wherein the electrical connection between the socket contacts and the base contacts is provided through a contact configuration or a contact support that does not provide forces opposite to the pressing force, wherein the base contacts are configured as contacts that protrude from the base in a direction towards the cooling element, and wherein the contact force between the socket contacts and the base contacts is oriented substantially transversal to an effective direction of the pressing force, and wherein the base contacts are contact pins.

10. A lamp socket for supporting a light source provided with an LED, the lamp socket comprising:

a cooling element;

a socket housing which includes socket contacts for electrically connecting a light source; and a lamp base which supports an LED connected to a heat conducting element and is insertable in the socket housing and includes base contacts which are connectable with the socket contacts through a contact force for providing power to the LED, wherein the cooling element on a socket side is connected with the heat conducting element on a base side through a contact pressure that promotes heat transfer, wherein the contact pressure is provided through a pressing force generated by preloading the socket contacts in order for the cooling element to absorb heat generated by the LED during operation, and wherein the electrical connection between the socket contacts and the base contacts is provided through a contact configuration or a contact support that does not provide forces opposite to the pressing force, wherein the base contacts are configured as contacts which protrude laterally from the base circumference and the contact forces between the socket contacts and the base contacts essentially have the same effective direction as the pressing force, wherein the socket contacts are configured as contact clamps which receive the base contacts, and wherein the socket contacts are supported parallel to the effective direction of the pressing force so that they float in the socket housing and/or the base contacts are supported parallel to the effective direction of the pressing force so that they float in the lamp base, wherein the base contacts are oriented in a direction that is transversal to the effective direction of the pressing force, wherein the base contacts are flat blade contacts, and wherein contact forces of contact clamp arms receiving the base contacts between one another are oriented opposite to one another and with an effective direction that is parallel to the pressing force.

* * * * *